US007737815B2

(12) United States Patent
Kim et al.

(10) Patent No.: US 7,737,815 B2
(45) Date of Patent: Jun. 15, 2010

(54) DUAL CORE TRANSFORMER AND BACKLIGHT DRIVING UNIT FOR LIQUID CRYSTAL DISPLAY DEVICE INCLUDING THE SAME

(75) Inventors: Sung-Joong Kim, Gyeonggi (KR); Sin-Kyun Park, Gyeonggi-Do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 12/314,509

(22) Filed: Dec. 11, 2008

(65) Prior Publication Data

US 2009/0273430 A1 Nov. 5, 2009

(30) Foreign Application Priority Data

Apr. 30, 2008 (KR) ..... 10-2008-0040471

(51) Int. Cl.
*H01F 27/24* (2006.01)
*H01F 27/30* (2006.01)
*H01F 27/29* (2006.01)

(52) U.S. Cl. ..... 336/212; 336/208; 336/198

(58) Field of Classification Search ..... 336/208, 336/198, 192, 212, 220
See application file for complete search history.

(56) References Cited

U.S. PATENT DOCUMENTS

| | | | | |
|---|---|---|---|---|
| 2004/0125628 | A1* | 7/2004 | Yamada et al. | 363/177 |
| 2006/0066246 | A1* | 3/2006 | Ushijima et al. | 315/57 |
| 2006/0290453 | A1* | 12/2006 | Park et al. | 336/69 |
| 2007/0262842 | A1* | 11/2007 | Chan et al. | 336/170 |
| 2008/0024261 | A1* | 1/2008 | Shinmen et al. | 336/208 |
| 2009/0230869 | A1* | 9/2009 | Suzuki et al. | 315/57 |

FOREIGN PATENT DOCUMENTS

| | | | |
|---|---|---|---|
| JP | 2004349040 | A * | 12/2004 |
| JP | 2008098350 | A * | 4/2008 |

* cited by examiner

*Primary Examiner*—Anh T Mai
(74) *Attorney, Agent, or Firm*—Morgan Lewis & Bockius LLP

(57) ABSTRACT

A dual core transformer including a bobbin having a through-hole along a first direction; a first coil wound around a first portion of the bobbin; a second coil wound around a second portion of the bobbin; first and second I cores inserted into the through-hole; and first and second C cores covering the first and second portions of the bobbin.

15 Claims, 5 Drawing Sheets

DUAL CORE TRANSFORMER AND BACKLIGHT DRIVING UNIT FOR LIQUID CRYSTAL DISPLAY DEVICE INCLUDING THE SAME

The present invention claims the benefit of Korean Patent Application No. 10-2008-0040471 filed in Korea on Apr. 30, 2008, which is hereby incorporated by reference.

BACKGROUND OF THE INVENTION

1. Field of the Invention

The invention relates to a dual core transformer and a backlight driving unit for a liquid crystal display (LCD) device, and more particularly, to a dual core transformer having an improved capacity and a backlight driving unit including the dual core transformer.

2. Discussion of the Related Art

As the society has entered in earnest upon an information age, a field of display devices that represent all sorts of electrical signals as visual images has developed rapidly and many kinds of flat panel display devices (FPDs), such as liquid crystal display (LCD) devices, plasma display panels (PDPs), field emission display (FED) devices, electroluminescence display (ELD) devices, and so on, have been introduced. Since they have excellent capabilities of a thin profile, light weight and low power consumption, and so on, they are substituted for the cathode ray tube (CRT) rapidly and came into the spotlight.

Among these devices, LCD devices are widely used for notebook computers, monitors, TV, and so on, because of their high contrast ratio and characteristics adequate to display moving images. Generally, an additional light source is required because the LCD panel is a non-emissive-type display device. Accordingly, a backlight unit is disposed under the LCD panel. The LCD device displays images using light produced by the backlight unit and supplied to the LCD panel.

The backlight unit may be divided into an edge type and a direct type depending on arrangement of light source. In the edge type backlight unit, one light source is positioned at a side of the backlight unit. Particularly, the light source is positioned at a side of a light guide plate of the backlight unit. Or, a pair of light sources is positioned at both side of the light guide plate. In the edge type backlight unit.

In the direct type backlight unit, at least one light source is positioned directly under an optical sheet. Because the higher brightness light is projected on a liquid crystal panel having the direct type backlight unit than the edge type backlight unit, the direct type backlight unit has been widely used.

FIG. 1 is a cross-sectional view of the related art direct type liquid crystal display module (LCDM). Referring to FIG. 1, the LCDM includes a liquid crystal panel 10, a backlight unit 20, a main frame 30, a top frame 40 and a bottom frame 50. The liquid crystal panel 10 includes first and second substrates 12 and 14 facing each other and a liquid crystal layer therebetween.

The backlight unit 20 is disposed at a backside of the liquid crystal panel 10. The liquid crystal display panel 10 and the backlight unit 20 are combined using the main frame 30 that can prevent movement of the liquid crystal panel 10 and the backlight unit 20. The top frame 40 cover edges of the liquid crystal panel 10 and sides of the main frame 30, so the top frame 40 can support and protect of the edges of the liquid crystal panel 10 and sides of the main frame 30. The bottom frame 50 covers back edges of the main frame 30, so the bottom frame 50 is combined with the main frame 30 and the top frame 40 for modulation.

The backlight unit 20 includes a reflective sheet 22, a plurality of lamps 24, a side support 26 and an optical sheet 28. The reflective sheet 22 is disposed on the bottom frame 50, and the lamps 24 are arranged on the reflective sheet 22. The side support 26 is disposed at both ends of each of the lamps 24 to fix the lamps 24. The optical sheet 28 is disposed over the lamps 24 and under the liquid crystal panel 10. The light from the lamps 24 has an uniform brightness after passing through the optical sheet 28. The lamp 24 includes a cold cathode fluorescent lamp (CCFL) or an external electrode fluorescent lamp (EEFL).

In addition, a backlight driving unit for controlling a drive of the lamp 24*s* is connected to the lamps 24. The backlight driving unit includes an inverter (not shown) on a printed circuit board (PCB) 70 and at least one transformer 72 on the inverter. The inverter controls an ON/OFF of the lamps 24 and the transformer 72 amplifies an alternating voltage and outputs an amplified alternating voltage. The PCB 70 is bent toward the backside of the bottom frame 50 so as to be disposed at the backside of the bottom frame 50.

Recently, as the LCD device has a larger size, the backlight unit including a plurality of lamps and driven by a parallel driving method is introduced to reduce production costs. There is another advantage of reducing a number of an inverter. However, because a capacity of a transformer is required, the LCD device having a relatively large size should have a plurality of transformers. For example, since a 47-inch LCD device requires at least four transformers having a 60 watt capacity. When at least four transformers are used, there is an enough distance between adjacent transformers because of interference of them. As a result, a size of the backlight driving unit increases. Moreover, each transformer is setup on each backlight driving unit, an assembling process is complicated and production costs increase.

SUMMARY OF THE INVENTION

Accordingly, embodiments of the invention are directed to a dual core transformer and a backlight driving unit for an LCD device including the same that substantially obviate one or more of the problems due to limitations and disadvantages of the related art.

An object of the invention is to provide a dual core transformer having a reduced size and a backlight driving unit including the same.

Another object of the invention is to simplify an assembling process and reduce production costs in a backlight driving unit.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the invention, as embodied and broadly described, a dual core transformer including a bobbin having a through-hole along a first direction; a first coil wound around a first portion of the bobbin; a second coil wound around a second portion of the bobbin; first and second I cores inserted into the through-hole; and first and second C cores covering the first and second portions of the bobbin.

In another aspect, a driving unit for a backlight unit of a liquid crystal display device including an printed circuit board connected to the backlight unit; and a dual core transformer disposed on the printed circuit board, the dual core transformer including: a bobbin having a through-hole along a first direction; a first coil wound around a first portion of the bobbin; a second coil wound around a second portion of the bobbin; first and second I cores inserted into the through-hole; and first and second C cores covering the first and second portions of the bobbin.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principle of the invention. In the drawings.

DETAILED DESCRIPTION OF EXEMPLARY EMBODIMENTS

Reference will now be made in detail to exemplary embodiments of the invention, which are illustrated in the accompanying drawings.

Figure 1:
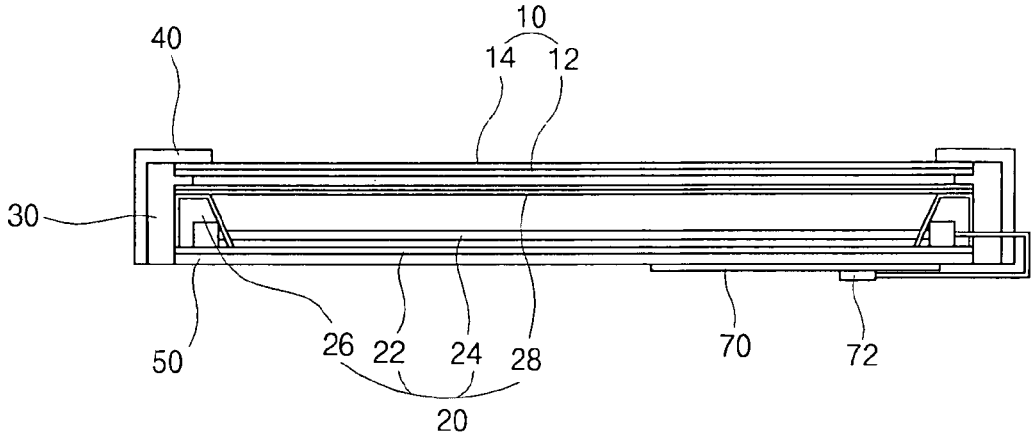
FIG. 1 RELATED ART
FIG. 1 is a cross-sectional view of the related art direct type liquid crystal display module (LCDM)
Figure 2:
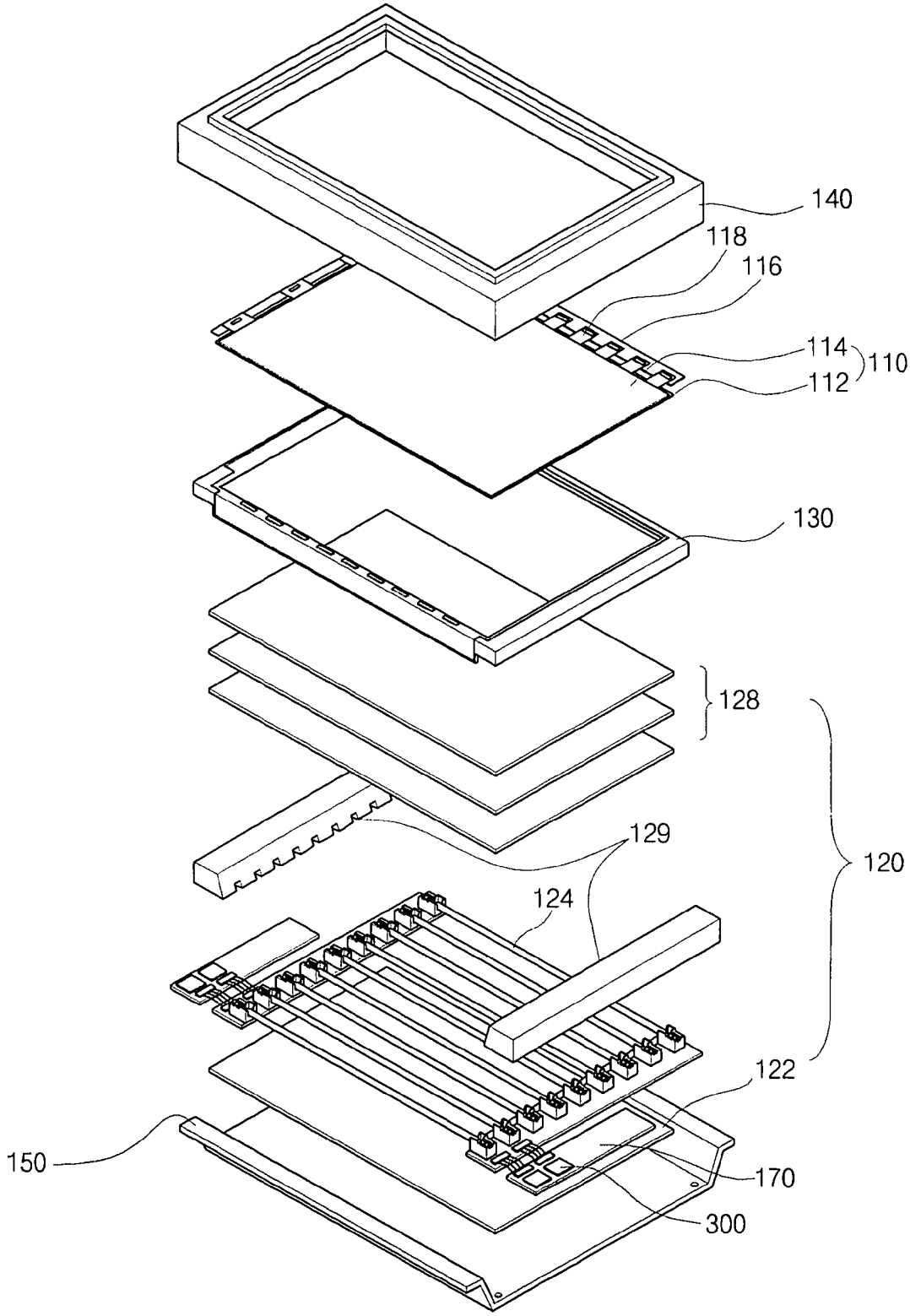
FIG. 2 is an exploded perspective view of a liquid crystal display panel (LCDM) according to the present invention.

FIG. 2 is an exploded perspective view of a liquid crystal display panel (LCDM) according to the present invention.

Referring to FIG. 2, the LCDM includes a liquid crystal panel 110, a backlight unit 120, a main frame 130, a top frame 130 and a bottom frame 150. The liquid crystal panel 110 includes first and second substrates 112 and 114 facing each other and a liquid crystal layer (not shown) therebetween. When the liquid crystal panel 110 is driven in an active matrix type, a gate line (not shown) and a data line (not shown), which cross each other to define a pixel region (not shown), are formed on the first substrate 112. The first substrate 112 may be referred to as an array substrate. A thin film transistor (TFT) (not shown) is disposed at a crossing portion of the gate and data lines (not shown). A pixel electrode (not shown) in each pixel region (not shown) is connected to the TFT (not shown).

A black matrix (not shown) having a lattice shape is formed on the second substrate 114. The black matrix (not shown) corresponds to a non-display region, such as the gate line (not shown), the data line (not shown) and the TFT (not shown). A color filter layer (not shown), which includes red, green and blue sub-color filters and corresponds to each pixel region (not shown), is formed on the second substrate 114. Moreover, a common electrode (not shown) is formed on the black matrix (not shown) and the color filter layer (not shown). The second substrate 114 may be referred to as a color filter substrate.

The liquid crystal panel 110 is connected to gate and data printed circuit boards (PCBs) 116 through a flexible circuit board 118 that provide a scanning signal and an image signal to the liquid crystal panel 110, respectively. The printed circuit board 116 is bent along a side of the main frame 130 or toward a backside of the bottom frame 150.

When the TFT (not shown) has an ON state by the scanning signal, the image signal is applied to the pixel electrode through the data line to produce an electric field between the pixel electrode (not shown) and the common electrode (not shown). As a result, as the intensity or direction of the electric field is changed, the alignment of the liquid crystal molecules (not shown) in the liquid crystal layer (not shown) also changes such that light transmissivity is controlled.

Although not shown, first and second alignment layers are formed on the first and second substrates 112 and 114, respectively, to determine an initial arrangement of the liquid crystal molecules. A seal pattern is formed along edges of the first and second substrates 112 and 114 to prevent leakage of the liquid crystal molecules. In addition, first and second polarizers are formed on an outer side of the first and second substrates 112 and 114, respectively.

The backlight unit 120 is disposed at a backside of the liquid crystal panel 110. The backlight unit 120 includes a reflective sheet 122, a plurality of lamps 124, an optical sheet 128 and a side support 129. The bottom frame 150 covers back edges of the main frame 130, so the bottom frame 150 is combined with the main frame 130 and the top frame 140 for modulation.

The lamp 124 includes a fluorescent lamp, for example, a cold cathode fluorescent lamp (CCFL) or an external electrode fluorescent lamp (EEFL) as a light source. The lamps 124 are arranged to be parallel to and spaced apart from each other. The reflective sheet 122 is disposed on a bottom surface of the bottom frame 150, and the lamps 124 are disposed on the reflective sheet 122. The side support 129 corresponds to both edges of each of the lamps 124 and is coupled with both sides of the bottom frame 150 to fix the lamps 124. The optical sheet 126 is disposed over the lamps 124 and under the liquid crystal panel 110. The light from the lamps 124 to the reflective sheet 124 is reflected on the reflective sheet 124 to be incident on the liquid crystal panel 110. Since light emitted from the lamp 124 is reflected on the reflective sheet 122, the LCDM has an improved brightness. The optical sheet 126 includes at least one diffusion plate (not shown) and at least one prism sheet (not shown) as a light condensing sheet. By the light passing through the plurality of optical sheets 126, it has a uniform brightness.

The liquid crystal display panel 110 and the backlight unit 120 are combined using the main frame 130 and the top frame 140 that can prevent movement of the liquid crystal panel 110 and the backlight unit 120. The top frame 140 cover edges of the liquid crystal panel 110 and sides of the main frame 130, so the top frame 140 can support and protect of the edges of the liquid crystal panel 110 and sides of the main frame 130. As mentioned above; the bottom frame 150 having a bottom surface frame and four side surfaces covers back edges of the main frame 130, so the bottom frame 150 is combined with the main frame 130 and the top frame 140 for modulation. Moreover, images from the liquid crystal panel 110 can be displayed through an opening of the top frame 140.

In addition, a backlight driving unit for controlling a drive of the lamps 124 is connected to the lamps 124 through a connecting unit, e.g., a cable. The backlight driving unit includes an inverter (not shown) on a printed circuit board (PCB) 170 and a dual core transformer 72 on the inverter. The PCB 170 is bent toward the backside of the bottom frame 150 so as to be disposed at the backside of the bottom frame 150. A dual core transformer 300 is disposed in the inverter.

Figure 3:
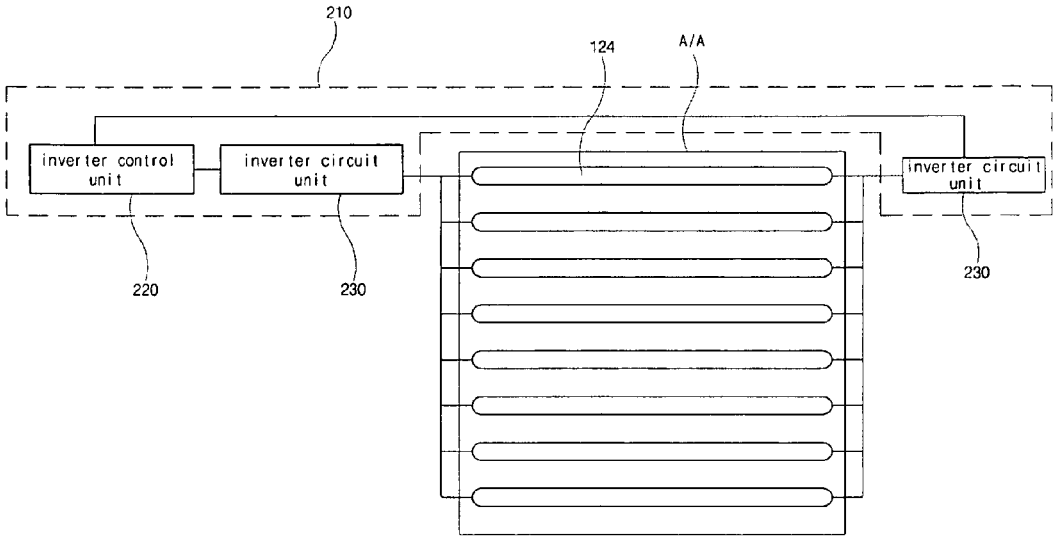
FIG. 3 is a diagram explaining a driving method of a backlight unit for a liquid crystal display (LCD) device according to the present invention.

FIG. 3 is a diagram explaining a driving method of a backlight unit for a liquid crystal display (LCD) device according to the present invention. Referring to FIG. 3, a plurality of lamps 124 are disposed in an active area A/A to be parallel to and spaced apart from each other. The active area A/A may be referred to as an image displaying area and correspond to an area of displaying an image on the liquid crystal panel 10 (of FIG. 2).

A backlight unit includes a backlight driving unit 210 for controlling a drive of the lamp 124. The backlight driving unit 210 may be referred to as a lamp driving unit. The backlight driving unit 210 includes the PCB 170 (of FIG. 2) and an inverter (not shown) on the PCB. The inverter includes a dual core transformer 300 (of FIG. 2), an inverter circuit unit 230 and an inverter control unit 220. The inverter circuit unit 230 connects the lamps 124 in parallel to drive the lamps 124. The inverter control unit 220 controls the inverter circuit unit 230.

The lamps 124 may be a fluorescent lamp. The lamp 124 includes a glass tube and two electrodes at both ends of the glass tube. The glass tube is filled with mercury (Hg) and an inert gas, typically an argon (Ar) gas or a neon (Ne) gas, as a discharging gas. A fluorescent material of a rare earth element, such as yttrium (Y), cerium (Ce) and terbium (Tb), is coated on an inside surface of the glass tube. When an ultraviolet (UV) ray is irradiated on the fluorescent material, the fluorescent material emits a visible ray.

When the backlight unit is turned ON, the voltage is provided into the electrodes of each of the lamps 124. So electrons will migrate through the gas from one end of the glass tube to the other. This energy changes some of the mercury in the tube from a liquid to a gas. As electrons and charged atoms move through the tube, some of them will collide with the gaseous mercury atoms. These collisions excite the atoms, bumping electrons up to higher energy levels. When the electrons return to their original energy level, they release light photons in the UV wavelength range. The light photons in the UV wavelength range is changed through the fluorescent material on the inside surface of the glass tube into the visible ray. As a result, the lamp 124 emits the visible ray.

The inverter circuit unit 230 is controlled by a control signal from the inverter control unit 220. The inverter circuit unit 230 generates the alternating voltage for driving the lamps 124. The inverter circuit unit 230 includes the dual core transformer 300 (of FIG. 2) amplifying an input alternating voltage.

By the dual core transformer in the present invention, the lamps 124 in the LCD device having a large sized above 47 inches are driven in parallel.

Figure 4:
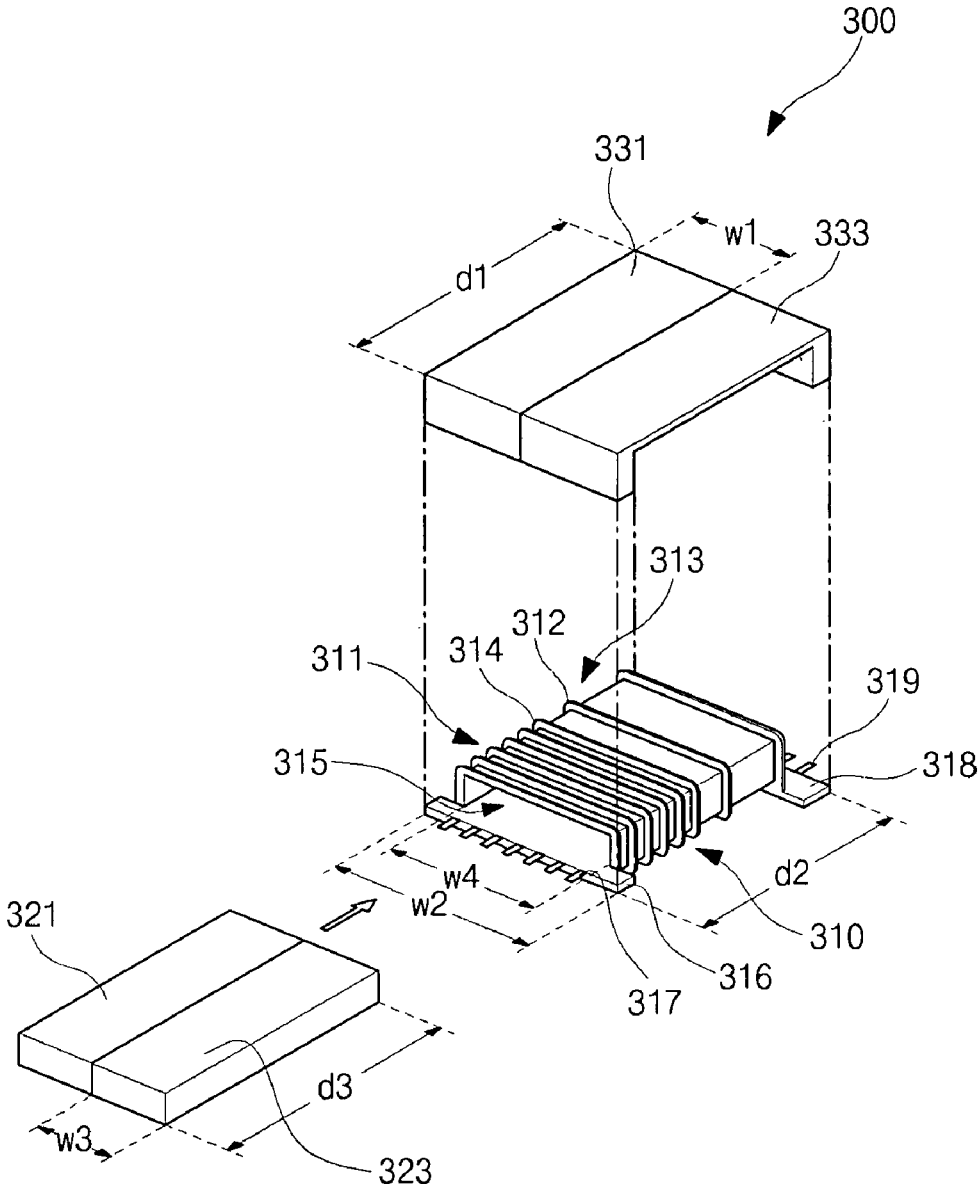
FIG. 4 is an exploded perspective view of a dual core transformer according to the present invention.

FIG. 4 is an exploded perspective view of a dual core transformer according to the present invention. In FIG. 4, the dual core transformer 300 according to the present invention includes a bobbin 310 having a first coil winding portion 311 and a second coil winding portion 313, first and second I cores 321 and 323, and first and second C cores 331 and 333. Each of the first and second I cores 321 and 323 has an "I" shape, and each of the first and second C cores 331 and 333 has a "C" shape.

A first side coil (not shown) and a second side coil (not shown) are wounded around the first and second coil winding portions 311 and 313, respectively. The bobbin 310 has a through-hole 315 and includes a first lead pin 317 in an input side and a second lead pin 319 in an output side. The first and second I cores 321 and 323 are inserted into the through-hole 315 of the bobbin 310. The first and second C cores 331 and 333 covers the bobbin 310 along a length direction. The first and second C cores 331 and 333 correspond to the first and second I cores 321 and 323 in the through-hole 315 of the bobbin 310, respectively. In other word, the first and second C cores 331 and 333 correspond to the first and second coil winding portions 311 and 313.

The dual core transformer 300 having the above structure may be referred to as a CI core transformer. The dual core transformer 300 according to the present invention has two I cores, e.g., the first and second I cores 321 and 323, and two C cores, e.g., the first and second C cores 331 and 333.

A first wall 312 surrounding the bobbin 310 is formed at a boundary of the first and second coil winding portions 311 and 313. The first wall 312 may be positioned at a center of the bobbin 310. In addition, a plurality of second walls 314 spaced apart from each other by a predetermined distance are formed in the first coil winding portion 311. Each second wall 314 also surrounds the bobbin 310.

The first and second coil winding portions 311 and 313 are spaced apart from each other by a predetermined distance to obtain a creepage distance for an insulating property. The creepage distance means a minimum distance between two adjacent conductive portions. The creepage distance corresponds to a distance of an insulating portion between the two adjacent conductive portions. For example, the creepage distance between the first and second coil winding portions 311 and 313 may be above about 20 micrometers.

The dual core transformer 300 further includes first and second lead substrates 316 and 318 at both ends of the bobbin 310, respectively. Each of the first and second lead substrates 316 and 318 protrudes from a bottom surface of the bobbin 310 and a side surface of the bobbin 310. The first and second lead pins 317 and 319 protrude from the first and second lead substrates 316 and 318, respectively.

When the bobbin 310 is disposed on the printed circuit board (PCB) 170(of FIG. 2), the first and second lead substrates 316 contacts the PCB 170. The first and second lead pins 317 and 317 are attached and electrically connected to the PCB 170 by a soldering process. In this case, the bobbin 310, the first wall 312 and the second walls 314 are spaced apart from the PCB 170.

Each of the first and second C cores 331 and 333 has a first length "d1" and a first width "w1". The bobbin 310 has a second width "w2" and a second length "d2". In more detail, the second width is a distance between ends of one of the first and second lead substrates 316 and 318, and the second distance is a distance between opposite ends of the first lead substrate 316 and the second lead substrate 318. Each of the first and second I cores 321 and 323 has a third length "d3" and a third width "w3". In addition, the through-hole 315 of the bobbin 310 has a fourth width "w4". The length is measured along an inserting direction of the first and second I cores 321 and 323, and the width is measured along a perpendicular to the inserting direction of the first and second I cores 321 and 323.

The first length "d1" of each of the first and second C cores 331 and 333 is substantially same as the second length "d2" of the bobbin 310. The first width "w1" of each of the first and second C cores 331 and 333 is a half of the second width "w2" of the bobbin 310. Namely, a summation of the widths of the first and second C cores 331 and 333 is substantially same as the second width "w2" of the bobbin 310.

The third length "d3" of each of the first and second I cores 321 and 323 is substantially same as the second length "d2" of the bobbin 310. The third width "w3" of each of the first and second I cores 321 and 323 is a half of the fourth width "w4" of the through-hole 315 of the bobbin 310. Namely, a summation of the widths of the first and second I cores 321 and 323 is substantially same as the fourth width "w4" of the through-hole 315 of the bobbin 310.

The dual core transformer 300 according to the present invention has the cores 321, 323, 331 and 333 having an area twice that of the cores in the related art transformer. As a result, the dual core transformer 300 has an improved capacity. For example, the dual core transformer 300 may have a capacity twice that of the related art transformer. It is because a capacity of a transformer is proportion to an area of cores. If the related art transformer has a capacity of about 60 watts, the dual core transformer 300 has a capacity of about 120 watts.

Four transformers each having a capacitor of about 60 watts are required for the backlight unit of the 47 inches LCD device, while the 47 inches LCD device requires only two transformers according to the present invention due to their improved capacity.

Since a number of a required transformer is reduced, an area of a driving circuit for the backlight unit can be minimized. A space between adjacent transformers is required because an interference therebetween. As there are more transformers, the much space is required. Accordingly, the LCD device using the dual core transformers according to the present invention has a minimized size. Moreover, an assembling process for the transformer is simplified.

Particularly, there are two I cores 321 and 323 and two C cores 331 and 333 in one bobbin 310. Accordingly, a number of a required bobbin for obtaining a certain capacity is reduced such that production costs decrease. Namely, since the dual core transformer 300 having one bobbin 310 has the same capacitor as the two related art transformers 300, costs for the transformer decrease.

Figure 5:
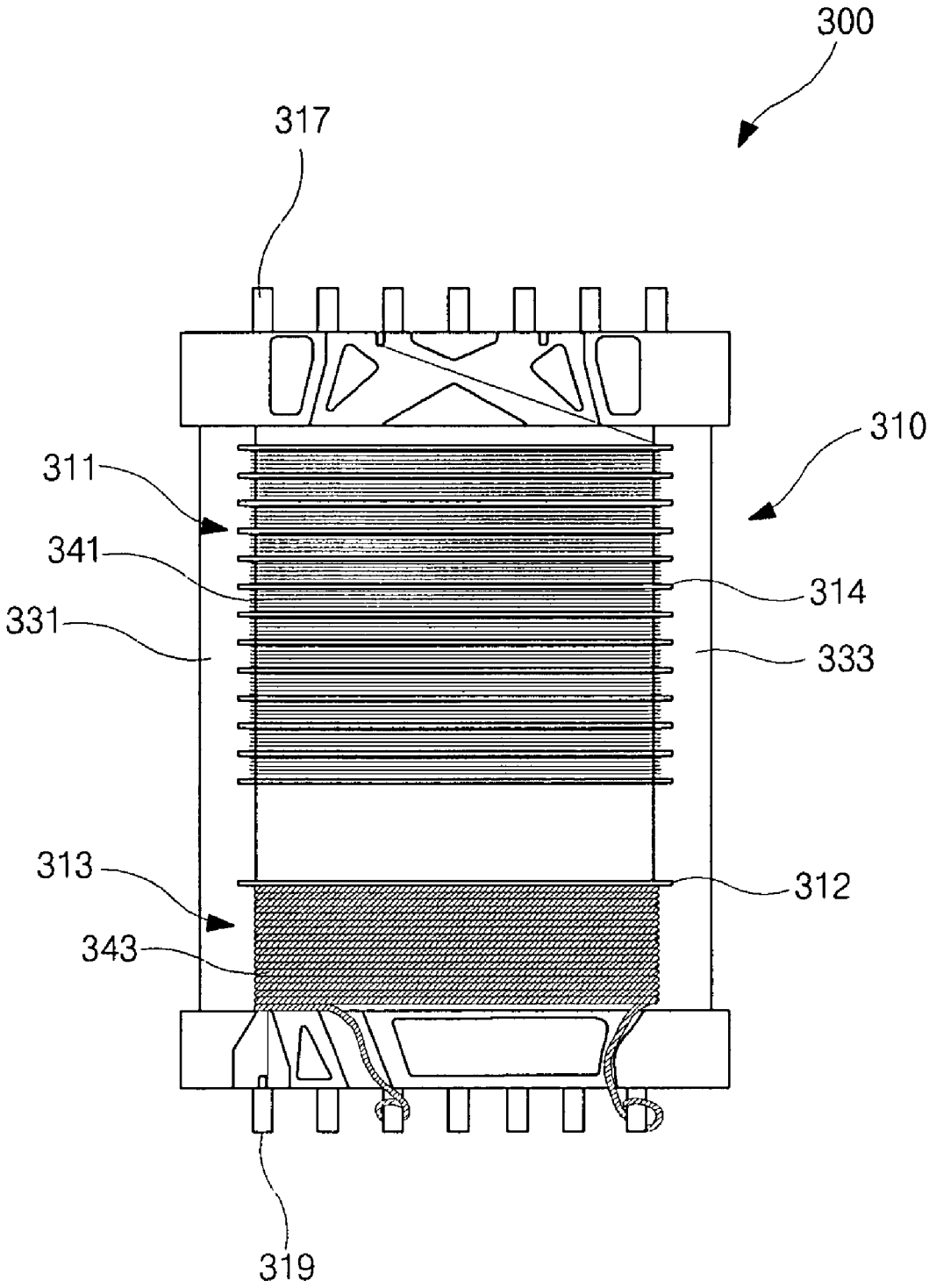
FIG. 5 is an assembled view of a dual core transformer in FIG. 4.

FIG. 5 is an assembled view of a dual core transformer in FIG. 4. In FIG. 5, the first coil 341 and the second coil 343 are wound around the first and second coil winding portions 311 and 313, respectively. The first coil 341 and second coil 343 are connected to the first and second lead pins 317 and 319, respectively. A low alternating voltage is applied to the first coil 341 via the first lead pin 317. The low alternating voltage is amplified by the first and second coils 341 and 343, and then the amplified voltage is applied to the lamp 124 (of FIG. 2) via the second lead pin 319.

An induced current generates in the second coil 343 by a magnetic induction phenomenon depending on a change of a current in the first coil 341. The dual core transformer 300 outputs an voltage being proportion to an area of the first and second I cores 321 and 323 and the first and second C core 331 and 333.

In another embodiment, a summation of the widths of the first and second C cores 331 and 333 may be larger than the width of the bobbin 310 within a range of about 40% of the width of the bobbin 310. The transformer according to the present invention may have a single core in one of the C core and the I core. A single C core may be used instead of the first and second C cores 331 and 333. In this case, the single C core has a width of a summation of the widths of the first and second C cores 331 and 333 and a length being same as each of the first and second C cores 331 and 333. Contrarily, a single I core may be used instead of the first and second I cores 321 and 323. In this case, the single I core has a width of a summation of the widths of the first and second I cores 321 and 323 and a length being same as each of the first and second I cores 321 and 323.

Since the dual core transformer 300 according to the present invention has an improved capacity with two I cores 321 and 323 and two C cores 331 and 333, the dual core transformer 300 is powerful for the lamps, which are driven in parallel, of the large size LCD device. Accordingly, a number of a required transformer is reduced such that an area of a driving circuit for the backlight unit can be minimized. Moreover, an assembling process for the transformer is simplified. In addition, production costs for the transformer are also reduced.

It will be apparent to those skilled in the art that various modifications and variations can be made in the exemplary embodiments of the dual core transformer and the backlight driving unit without departing from the spirit or scope of the invention. Thus, it is intended that the invention cover the modifications and variations of this invention provided they come within the scope of the appended claims and their equivalents.

What is claimed is:

1. A dual core transformer, comprising:

one bobbin having single through-hole along a first direction;

a first coil wound around a first portion of the bobbin;

a second coil wound around a second portion of the bobbin;

first and second I cores inserted into the through-hole; and first and second C cores covering the first and second portions of the bobbin.

2. The transformer according to claim 1, where each of the first and second C cores has a first length along the first direction and a first width along a second direction perpendicular to the first direction, and the bobbin has a second length along the first direction and a second width along the second direction, and wherein the first length is substantially same as the second length, and a summation of the first widths of the first and second C cores is substantially same as the second widths.

3. The transformer according to claim 1, where each of the first and second C cores has a first width along a second direction perpendicular to the first direction and the bobbin has a second width along the second direction, and wherein a summation of the first widths of the first and second C cores larger than the second widths.

4. The transformer according to claim 1, wherein each of the first and second I cores has a first length along the first direction and a first width along a second direction perpendicular to the first direction, and the bobbin has a second length along the first direction and a second width along the second direction, and wherein the first length is substantially same as the second length, and a summation of the first widths of the first and second I cores is substantially same as the second widths.

5. The transformer according to claim 1, further comprising:

a first wall at a boundary of the first and second portions and surrounding an outer surface of the bobbin; and a plurality of second walls in the first portion.

6. The transformer according to claim 1, further comprising:

first and second lead substrates respectively disposed at both ends of the bobbin; and first and second lead pins respectively disposed on the first and second lead substrates, wherein the first coil is connected to one of the first and second pins, and the second coil is connected to the other one of the first and second pins.

7. The transformer according claim 1, wherein the first coil and the second coil are spaced apart from each other.

8. The transformer according to claim 1, wherein each of the first and second I cores has an "I" shape, and each of the first and second C cores has a "C" shape.

9. A driving unit for a backlight unit of a liquid crystal display device, comprising:

an printed circuit board connected to the backlight unit; and a dual core transformer disposed on the printed circuit board, the dual core transformer including:

one bobbin having single through-hole along a first direction;

a first coil wound around a first portion of the bobbin;

a second coil wound around a second portion of the bobbin;

first and second I cores inserted into the through-hole; and first and second C cores covering the first and second portions of the bobbin.

10. The driving unit according to claim 9, where each of the first and second C cores has a first length along the first direction and a first width along a second direction perpendicular to the first direction, and the bobbin has a second length along the first direction and a second width along the second direction, and wherein the first length is substantially same as the second length, and a summation of the first widths of the first and second C cores is substantially same as the second widths.

11. The driving unit according to claim 9, where each of the first and second C cores has a first width along a second direction perpendicular to the first direction and the bobbin has a second width along the second direction, and wherein a summation of the first widths of the first and second C cores larger than the second widths.

12. The driving unit according to claim 9, wherein each of the first and second I cores has a first length along the first direction and a first width along a second direction perpendicular to the first direction, and the bobbin has a second length along the first direction and a second width along the second direction, and wherein the first length is substantially same as the second length, and a summation of the first widths of the first and second I cores is substantially same as the second widths.

13. The driving unit according to claim 9, wherein the dual core transformer further includes:

a first wall at a boundary of the first and second portions and surrounding an outer surface of the bobbin; and a plurality of second walls in the first portion.

14. The driving unit according to claim 9, wherein the dual core transformer further includes:

first and second lead substrates respectively disposed at both ends of the bobbin; and first and second lead pins respectively disposed on the first and second lead substrates, wherein the first coil is connected to one of the first and second pins, and the second coil is connected to the other one of the first and second pins.

15. The driving unit according to claim 9, wherein the first coil and the second coil are spaced apart from each other.

* * * * *